US007458473B1

(12) United States Patent
Mason

(10) Patent No.: US 7,458,473 B1
(45) Date of Patent: Dec. 2, 2008

(54) DISPLAY SHELF

(75) Inventor: Timothy L. Mason, Melville, NY (US)

(73) Assignee: New Dimensions Research Corporation, Melville, NY (US)

( * ) Notice: Subject to any disclaimer, the term of this patent is extended or adjusted under 35 U.S.C. 154(b) by 346 days.

(21) Appl. No.: 11/364,658

(22) Filed: Feb. 28, 2006

Related U.S. Application Data

(63) Continuation-in-part of application No. 29/244,141, filed on Dec. 6, 2005, now Pat. No. Des. 565,322.

(51) Int. Cl.
*A47F 7/00* (2006.01)

(52) U.S. Cl. ..... 211/59.3; 211/175

(58) Field of Classification Search ..... 211/59.2, 211/59.3, 175, 184; D6/407, 408; 312/61, 312/71; 221/227, 255, 279
See application file for complete search history.

(56) References Cited

U.S. PATENT DOCUMENTS 5,190,186 A * 3/1993 Yablans et al. ..... 221/124
5,265,738 A * 11/1993 Yablans et al. ..... 211/59.3
5,366,099 A * 11/1994 Schmid ..... 211/59.3
5,855,283 A * 1/1999 Johnson ..... 211/59.3
6,142,317 A * 11/2000 Merl ..... 211/59.3
6,357,606 B1 * 3/2002 Henry ..... 211/59.3
6,691,891 B2 * 2/2004 Maldonado ..... 221/279
6,823,997 B2 * 11/2004 Linden et al. ..... 211/59.3
7,168,579 B2 * 1/2007 Richter et al. ..... 211/59.3
2002/0148794 A1 * 10/2002 Marihugh ..... 211/59.3
2003/0217980 A1 * 11/2003 Johnson et al. ..... 211/59.3
2006/0186064 A1 * 8/2006 Merit et al. ..... 211/59.3
2006/0186065 A1 * 8/2006 Ciesick ..... 211/59.3
2006/0237381 A1 * 10/2006 Lockwood et al. ..... 211/59.3
2007/0068885 A1 * 3/2007 Busto et al. ..... 211/59.3
2007/0090068 A1 * 4/2007 Hardy ..... 211/59.3
2007/0170127 A1 * 7/2007 Johnson ..... 211/59.3
2007/0175839 A1 * 8/2007 Schneider et al. ..... 211/59.3

OTHER PUBLICATIONS

NDR Display Shelf for Nintendo Games 1990's.

* cited by examiner

*Primary Examiner*—Jennifer E. Novosad
(74) *Attorney, Agent, or Firm*—Collard & Roe, P.C.

(57) ABSTRACT

A display shelf for displaying a plurality of items of merchandise includes a tray having a base, a front portion, a rear portion, a first side, a second side, and a track disposed on the base. A first side member slidably engaging the first side of the tray and a second side member slidable engages the second side of the tray. The side members are displaceable to accommodate items of various widths. A biasing mechanism biases the items of merchandise toward the front of the tray, and has a biasing element and a merchandise advancing member slidably engaging the track. A stop tab is disposed on the base for restricting the rearward movement of the merchandise advancing member to limit the number of items than can be displayed on the display shelf.

8 Claims, 4 Drawing Sheets

DISPLAY SHELF

CROSS REFERENCE TO RELATED APPLICATIONS

This application is a continuation-in-part of application Ser. No. 29/244,141 filed on Dec. 6, 2005 Des. Pat. No. 565,322.

BACKGROUND OF THE INVENTION

1. Field of the Invention

The invention relates to display shelves for displaying items of merchandise. More particularly, the invention relates to display shelves including biasing mechanisms for biasing items of merchandise toward a front of the display shelf.

2. The Prior Art

Merchandise for retail sale is typically arranged in parallel rows on modular shelving units. Such an arrangement allows prospective purchasers to view and select a product for purchase. As merchandise is removed from a front of the display, the shelf is re-stocked and leveled by moving merchandise to a front of the shelf to present a neat, orderly and fully stocked appearance. It is known to use a biasing device to bias a row of products displayed on a shelf toward a front portion of the shelf. Such devices push a row of remaining products forward toward a front of the shelf as a product is removed, thereby maintaining a neat, fully stocked appearance and eliminating the need for manual leveling of shelves.

When existing display shelves including a biasing mechanism are re-stocked with merchandise, the person re-stocking the display shelf typically inserts as many items of merchandise as the particular display shelf can accommodate. The capacity of the display shelf in this connection is limited only by the rearward distance that the biasing device may travel. For a number of reasons, however, it may be desirable to limit the number of items which may be displayed on a display shelf. For example, it may be desired to limit the amount of a particular item of merchandise which has a high instance of theft to fewer than the total amount of items which the display shelf could otherwise accommodate. In this way, total loses due to theft of the item may be reduced.

Accordingly, the need exists for a display shelf having a biasing mechanism, wherein a rearward travel of the biasing mechanism may be selectively limited in order to limit the number of items of merchandise which the display shelf can hold.

SUMMARY OF THE INVENTION

A display shelf for displaying a plurality of items of merchandise according to an embodiment of the invention includes a tray having a base, a front portion, a rear portion, a first side, a second side, and a track disposed on the base between the first and second sides. The track extends substantially parallel to the first and second sides.

A first side member is disposed at the first side of the tray and is in sliding engagement with the tray. A second side member is disposed at the second side of the tray and is in sliding engagement with the tray. The first side member and second side member are displaceable for accommodating items of various widths.

A biasing mechanism for biasing the items of merchandise toward the front portion of the tray includes a biasing element and a merchandise advancing member slidably engaged with the track. A stop tab is disposed on the base of the tray and restricts a rearward movement of the merchandise advancing member to limit the number of items of merchandise to be displayed on the display shelf. The stop tab may be movable between a first position, wherein the rearward movement of the merchandise advancing member is restricted and a second position, wherein the rearward movement of the merchandise advancing member is not restricted.

One advantage of a display shelf according to an embodiment of the invention is that a stop tab is provided for limiting the rearward movement of a merchandise advancing member, thereby selectively limiting a number of items of merchandise which can be displayed. A further advantage of a display shelf according to an embodiment of the invention is that multiple stop tabs may be provided, allowing multiple settings for the permitted rearward travel of the product advancing member. A still further advantage of a shelf unit according to an embodiment of the invention is that displaceable side members may be provided for accommodating merchandise of various widths, thereby giving the display shelf adjustability in both width and depth.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
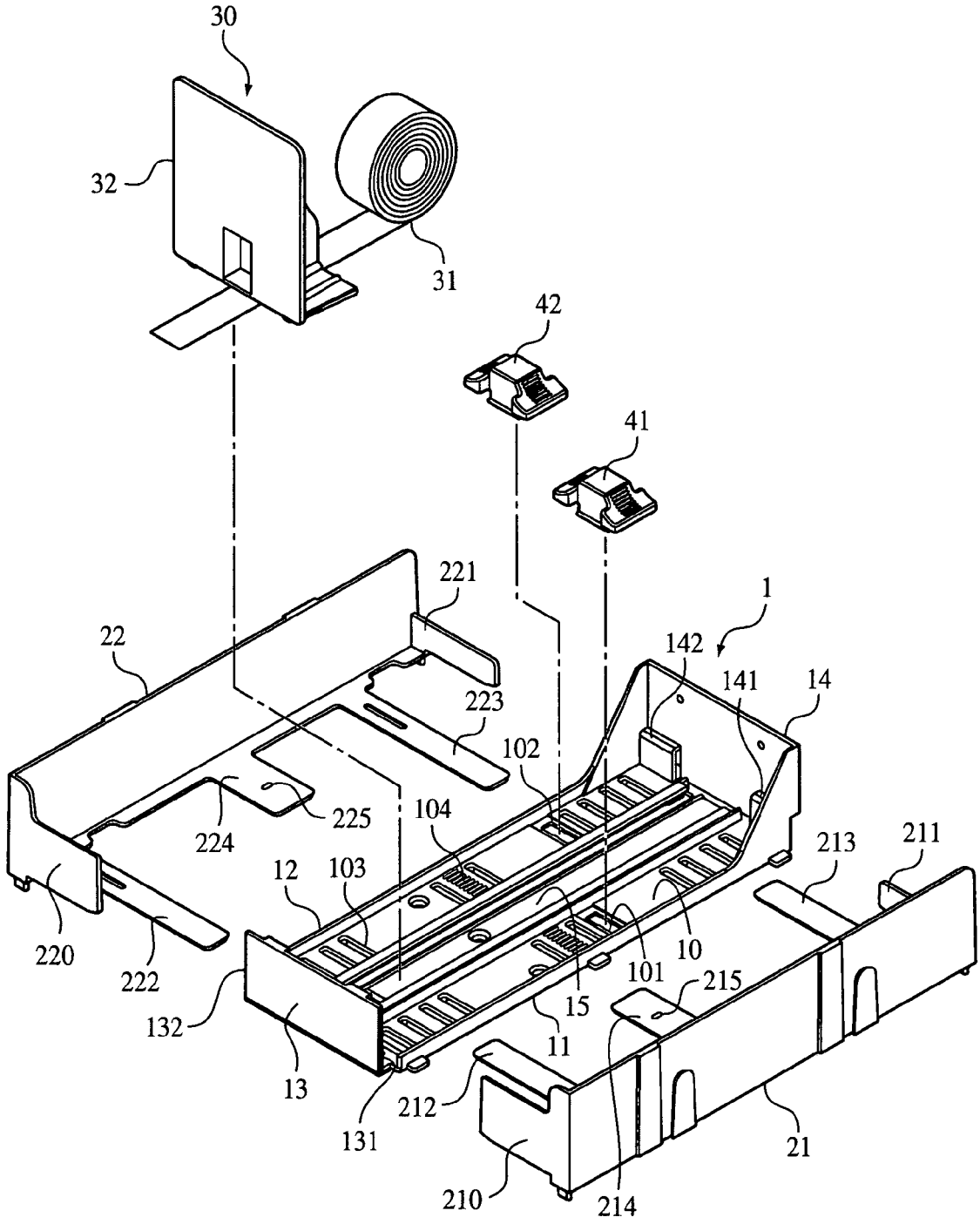
FIG. 1 shows an exploded view of a display shelf according to an embodiment of the invention.

Referring now in detail to the drawings and, in particular, FIG. 1 shows an exploded view of a display shelf according to an embodiment of the invention. Multiple display shelf units may be secured to a support in rows and/or columns. A display shelf according to an embodiment of the invention may be used for displaying a plurality of items of merchandise, for example packaged video game cartridges or discs, audio compact discs, digital video discs, computer software discs, or any other merchandise suitable for being stored and displayed on a shelf unit.

Video game cartridge packages which may be displayed on a display shelf according to an embodiment of the invention may have dimensions of approximately five to six inches wide (preferably approximately five and three quarters inches wide), approximately four to five inches high (preferably approximately four and three eighths inches high) and approximately three eighths to one inch thick (preferably approximately seven sixteenth inches thick). Video game disc packages which may be displayed on a display shelf according to an embodiment of the invention may have dimensions of approximately four and three quarter to six inches wide (preferably approximately five inches wide), approximately six to eight inches high (preferably approximately seven and one half inches high) and approximately one quarter to one inch thick (preferably approximately one half inch thick). Audio compact disc, digital video disc, and/or computer software disc packages which may be displayed on a display shelf according to an embodiment of the invention may have dimensions of approximately four and three quarters to six inches wide (preferably approximately five and nine sixteenth inches wide), approximately four and three quarter to eight inches high (preferably approximately four and seven eights inches high) and approximately one quarter to one inch thick (preferably approximately three eights inches thick). Display shelves according to embodiments of the invention can, of course, be configured and dimensioned to accommodate a wide variety of merchandise items of various sizes.

As shown, the display shelf includes a tray 1 having a base 10, a front portion 13, a rear portion 14, a first side 11 and a second side 12. Tray 1 may be constructed from any suitable rigid material, for example a plastic material. Additionally, tray 1 may comprise a transparent or translucent material. Tray 1 may have a length, for example, of approximately ten and one half inches measured from front portion 13 to rear portion 14 and a width of approximately three and one half inches. Front portion 13 may measure, for example, approximately three and one quarter inches across and rear portion 14 may measure approximately three and three quarter inches across.

A track 15 is disposed on tray 1 and extends substantially parallel to sides 11, 12. As shown, track 15 may be arranged substantially centered on the width of tray 1 and may extend along substantially the entire length of tray 1. Track 15 may comprise, for example a pair of opposing, inwardly facing bracket members for engaging a corresponding pair of projections 321 disposed on a merchandise advancing member 32 slidably engaging track 15.

First side member 21 is disposed at first side 11 of tray 1 and slidably engages tray 1. Likewise, second side member 22 is disposed at second side 12 of tray 1 and also slidably engages the tray. First side member 21 and second side member 22 may be constructed from any suitable rigid material, for example a plastic material and may comprise a transparent or translucent material. First side member 21 and second side member 22 may have a length of, for example, approximately ten inches. First side member 21 and second side member 22 may each comprise a wall portion extending upwardly so that the side members together with tray 1 form an enclosure around the bottom, front, back and sides of the items of merchandise. For example, side members 21, 22 may have a height of approximately two and one eighth inches, or any other height appropriate for the items of merchandise to be displayed.

As shown, first side member 21 may include a first front projection 210 disposed at a front portion of first side member 21 and a first rear projection 211 disposed at a rear portion of first side member 21. Front projection 210 slidably engages a front portion of tray 1 and rear projection 211 slidably engages a rear portion of tray 1. Similarly, second side member 222 may include a second front projection 220 disposed at a front portion of second side member 22 and a second rear projection 221 disposed at a rear portion of second side member 22. Front projection 220 slidably engages a front portion of tray 1 and rear projection 221 slidably engages a rear portion of tray 1. Each of front and rear projections 210, 220, 211, 221 may extend for a length of several inches, for example two and one quarter inches from the respective side member.

As shown, tray 1 may include a slots or recesses 131, 132 disposed at front portion 13, wherein the slot or recess is adapted to receive one or both front projections 210, 220 as shown. Tray 1 may further include slots or recesses 141, 142 disposed at rear portion 14, wherein the slot or recess is adapted to receive one or both of rear projections 211, 221 as shown.

First and second side members 21, 22 may include additional projections disposed at a lower portion thereof and projecting toward tray 1, as shown. For example, first side member 21 may include projection 214 and second side member 22 may include projection 224. Projections 214 and 224 may slidably engage corresponding guiding members disposed on an underside of tray base 10. For example, guiding members may comprise a pair of opposing, inwardly facing bracket members adapted to receive and guide the projections so that side members 21, 22 may slide toward and away from one another in a substantially linear motion.

A plurality of recesses 104 may be disposed on the underside of tray base 10 and adapted to receive a corresponding protrusion 215, 225 disposed on a top surface of projection 214, 224. Recesses 104 may comprise a plurality of spaced apart recesses, for example, eight recesses each spaced one eighth of an inch on center from adjacent recesses. Protrusions 215, 225 may engage recesses 104 as side members 21, 22 are displaced to provide a positive stop in the manner of a detent. In this way, side members 21, 22 can be extended and retracted in a stepped manner in controlled increments.

First side member 21 may have additional projections 212, 213 and second side member 22 may have additional projections 222, 223 disposed at a lower portion of the respective side member and projecting toward tray 1, as shown. Projections 212, 213, 222, 223 may slidably engage corresponding guiding members 103 disposed on an underside of tray base 10. For example, guiding members 103 may comprise a pair of opposing, inwardly facing bracket members adapted to receive and guide the projections so that side members 21, 22 may slide toward and away from one another in a substantially linear motion.

Figure 4:
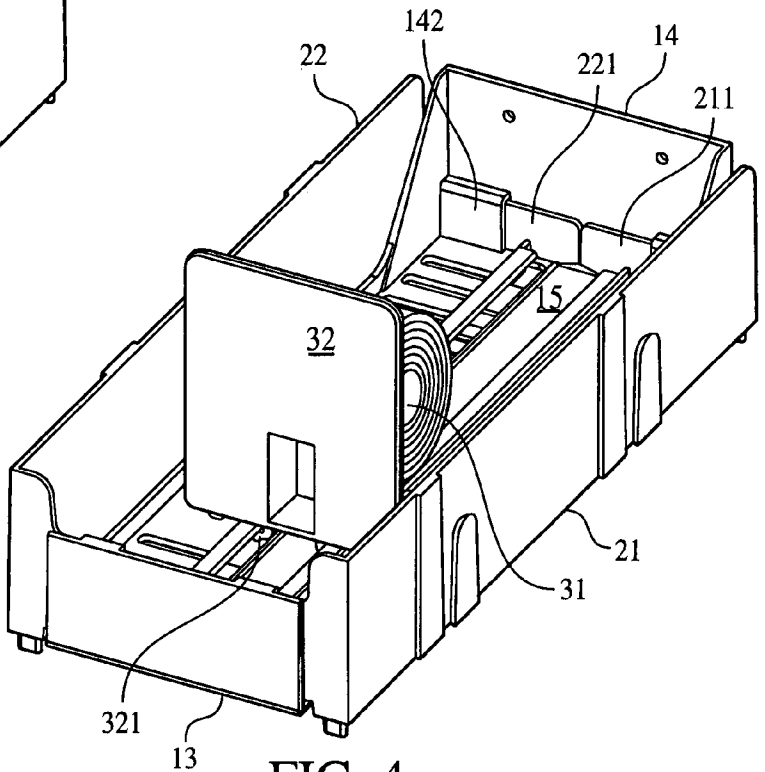
FIG. 4 shows a perspective view of a display shelf with side members in a contracted position according to an embodiment of the invention.
Figure 3:
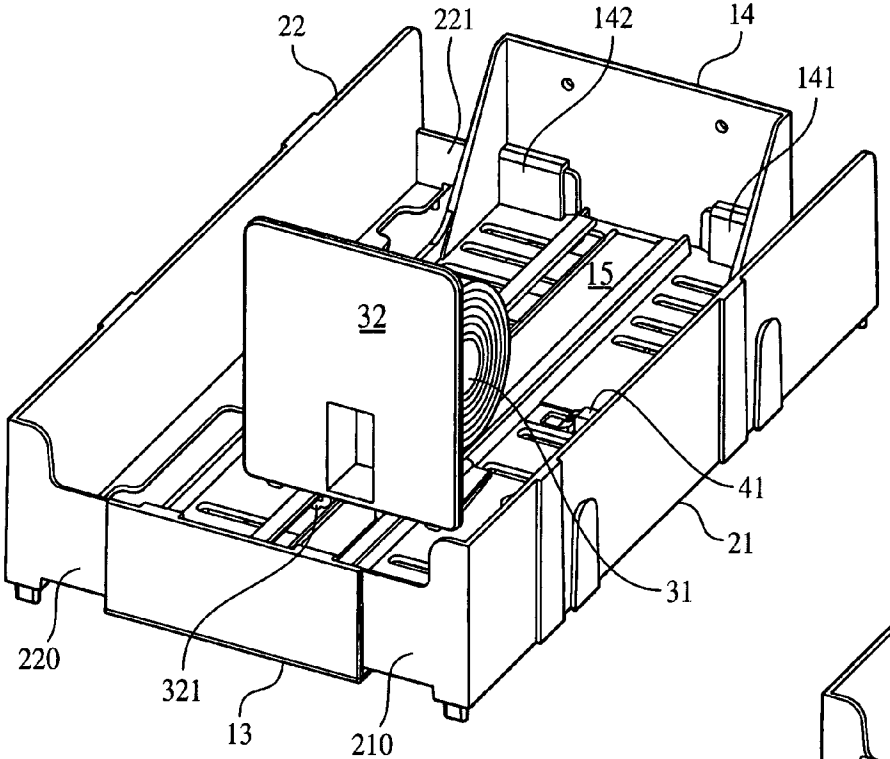
FIG. 3 shows a perspective view of a display shelf with side members in an expanded position according to an embodiment of the invention.

As illustrated in FIGS. 3 and 4, first side member 21 and second side 22 member are displaceable with respect to tray 1. This feature allows for adjustment in the width of a display shelf according to an embodiment of the invention. Accordingly, a display shelf according to an embodiment of the invention may accommodate items of merchandise of various widths. For example, side members 21, 22 may be extended to an open or expanded position, as shown in FIG. 3, to accommodate wider items and side members 21, 22 may be moved to a closed or contracted position, as shown in FIG. 4, to accommodate narrower width items. Side members 21, 22 may also be positioned at various intermediate positions according to the dimensions of the item of merchandise to be displayed. For example, a display shelf according to an embodiment of the invention may have a width of approximately five and seven eights inches in the open position illustrated in FIG. 3 and a width of approximately four and one quarter inches in the closed position illustrated in FIG. 4. These dimensions are exemplary only, and a display shelf according to an embodiment of the invention may be dimensioned and configured to accommodate merchandise items of various sizes.

Figure 5:
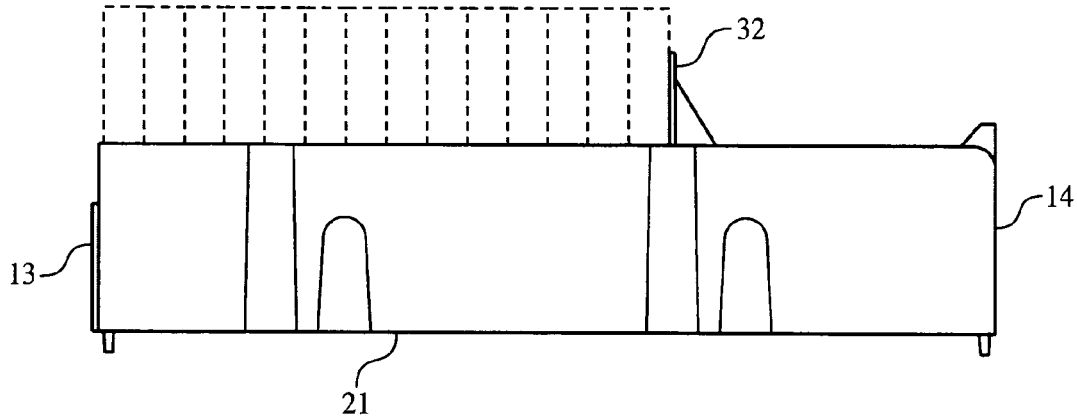
FIG. 5 shows a side view of a display shelf according to an embodiment of the invention, wherein a rearward movement of a merchandise advancing member is restricted by a stop tab.
Figure 6:
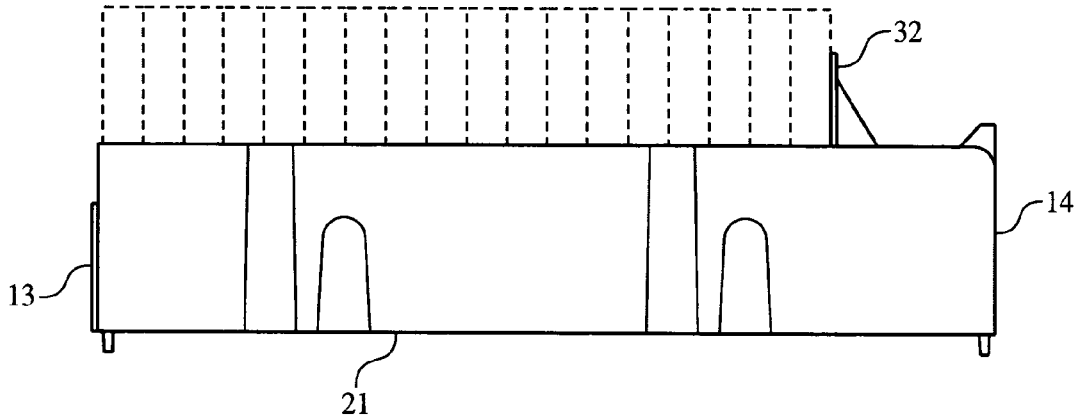
FIG. 6 shows a side view of a display shelf according to an embodiment of the invention, wherein a rearward movement of a merchandise advancing member is restricted by a stop tab disposed closer to the rear portion of the display shelf than the stop tab of the embodiment shown in FIG. 5.
Figure 7:
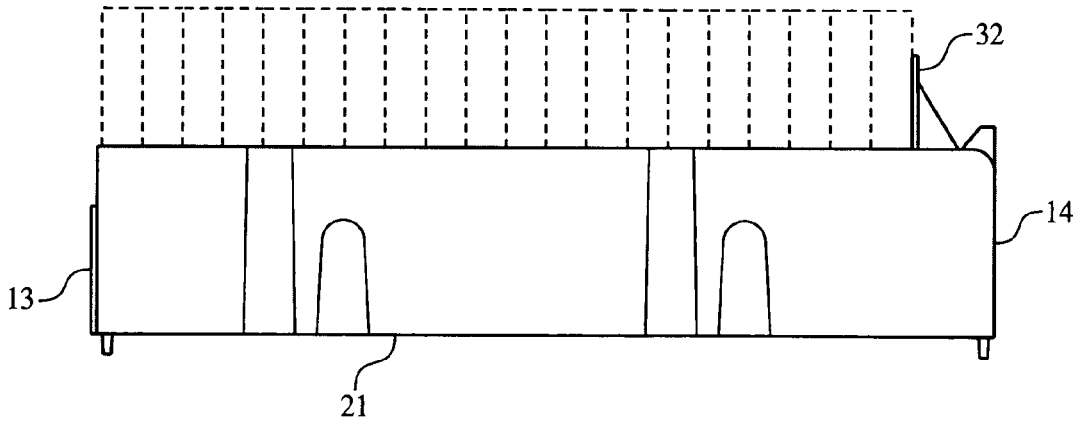
FIG. 7 shows a side view of a display shelf according to an embodiment of the invention, wherein a rearward movement of a merchandise advancing member is not restricted by a stop tab.

A display shelf according to an embodiment of the invention may further include a biasing mechanism or pusher 30 for biasing the items of merchandise toward the front of the display shelf, where the product can be viewed and accessed by prospective purchasers. As shown in FIGS. 5-7, biasing mechanism 30, including merchandise advancing member 32 may push against one of the items of merchandise which is situated at the rear of a row of items of merchandise disposed on the display shelf.

As shown in FIG. 1, biasing mechanism 30 includes a biasing element 31 and a merchandise advancing member 32. Merchandise advancing member 32 may be constructed from any suitable rigid material, for example a plastic material. Additionally, merchandise advancing member 32 may comprise a transparent or translucent material.

Merchandise advancing member 32 slidably engages track 15 and is adapted to move forward along track 15 toward front portion 13 of tray 1, and back along track 15 toward rear portion 14 of tray 1. As shown in FIGS. 3 and 4, merchandise advancing member 32 may include projections 321 disposed at a lower portion, wherein the projections engage a pair of opposing, inwardly facing bracket members on track 15. Merchandise advancing member 32 may have a face disposed substantially parallel to an item of merchandise located at a rear of a row of merchandise on the display shelf, wherein this face contacts the item of merchandise for pushing the one or more items of merchandise in a row toward the front portion 13 of the tray. A face of merchandise advancing member 32 may be, for example, three and one half inches high and two and three quarters inches wide, or any other dimensions as appropriate for the items of merchandise displayed.

Biasing element 31 may comprise, for example, a spring element which is secured at one end near front portion 13 of tray 1. In the embodiments shown, biasing element 31 comprises a length of flat metal spring material which is secured at one end near front portion 13 of tray 1, extends under merchandise advancing member 32, and forms a coil disposed behind merchandise advancing member 32. The coiled portion of biasing element 31 is uncoiled as merchandise advancing member 32 is moved toward a rear of tray 1. The coiled spring biases merchandise advancing member 32 toward a front of the display shelf. Thus, as items of merchandise are removed from a row of items disposed on the display shelf, biasing mechanism 30 displaces the remaining row of items toward a front of the display shelf, thereby maintaining a neat, fully stocked appearance and eliminating the need for manual leveling.

A display shelf according to an embodiment of the invention may further comprise one or more stop tabs 41, 42. The one or more stop tabs are disposed on base 10 of tray 1 and may be positioned to restrict the rearward movement of merchandise advancing member 32, thereby limiting the number of items of merchandise which can fit on the display shelf.

Figure 2:
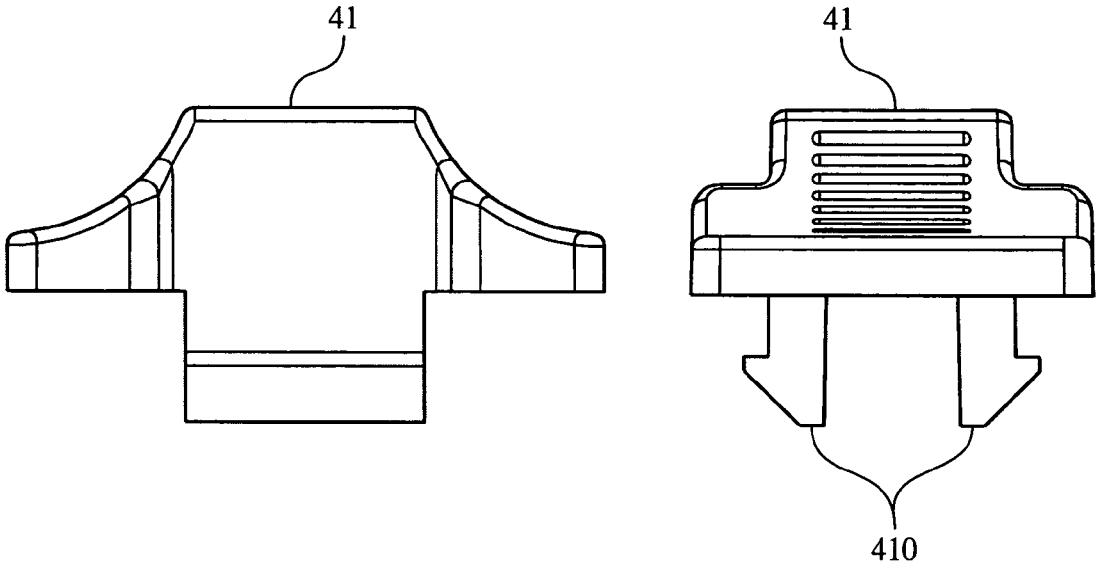
FIG. 2 shows a front and side view of a stop tab according to an embodiment of the invention.

FIG. 2 shows a front and side view of a stop tab 41 for restricting a rearward movement of a biasing mechanism 30 according to an embodiment of the invention. Stop tab 41 may be constructed from a plastic material, for example nylon or acrylonitrile butadiene styrene (ABS), or any other suitable material.

The one or more stop tabs function by providing a positive stop which prevents merchandise advancing member 32 from traveling along track 15 toward rear portion 14 of tray 1 when the stop tab is in position. Stop tab 41 may be movable between a first position, wherein the rearward movement of merchandise advancing member 32 is restricted or blocked, and a second position, wherein the rearward movement of merchandise advancing member 32 is not restricted. In this second position, merchandise advancing member 32 may be moved toward rear portion 14 of tray 1 against a spring force supplied by biasing element 31.

In an embodiment of the invention, stop tab 41 may be slidable between a first position for restricting the rearward movement of merchandise advancing member 32 and a second position, wherein the rearward movement of merchandise advancing member 32 is not restricted. For example, stop tab 41 may slidably engage a slot 101 provided in base 10 of tray 1. Slot 101 may be dimensioned to receive stop tab 41 and extend substantially perpendicular to the movement direction of biasing mechanism 30 so as to allow stop tab 41 to slide back and forth in a direction substantially perpendicular to the movement of the biasing mechanism. For example, slot 101 may measure approximately three quarters inches in length and one quarter inch wide, or any other dimensions adapted to receive stop tab 41.

Stop tab 41 may include one or more projections 410 extending downwardly from the tab for engaging slot 101. As shown in FIG. 2, projections 410 may comprise a pair of flexible prongs each having an angled head portion for engaging a respective side of slot 101 in tray 1. In operation, stop tab 41 may be selectively moved across tray 1 from a position adjacent side member 21, wherein the rearward movement of merchandise advancing member 32 is not restricted, to a position adjacent track 15, wherein the rearward movement of merchandise advancing member 32 is restricted. In a further embodiment, a stop tab may be removably engaged with tray 1 at a selected location along tray 1 for restricting the rearward movement of merchandise advancing member 32. The stop tab may be removed to allow merchandise advancing member 32 to travel freely toward rear portion 14 of tray 1 and inserted to restrict a rearward movement of merchandise advancing member 32 and limit the number of items of merchandise which can fit on the display shelf.

A display shelf according to an embodiment of the invention may further include a second stop tab 42, as shown in FIG. 1. Second stop tab 42 may be positioned at a greater distance from front portion 13 of tray 1 than first stop tab 41, as shown. For example, first stop tab 41 may be located approximately six inches from front portion 13 of tray 1 and second stop tab 42 may be located approximately seven and one half inches from front portion 13. In this way, a plurality of stop positions may be provided for selectively setting a desired rearward travel of merchandise advancing member 32 and accordingly limiting the number of merchandise items which the display shelf may accommodate.

Second stop tab 42 may engage a second slot 102 provided in base 10 of tray 1 and may operate similarly to first stop tab 41 as described above. As shown in FIG. 1, first stop tab 41 may be disposed adjacent to first side 11 of tray 1 and second stop tab 42 may be disposed on an opposite side of track 15, adjacent second side 12 of tray 1.

FIGS. 5-7 show a side view of a display shelf according to an embodiment of the invention with merchandise advancing member 32 in various exemplary positions with respect to display shelf tray 1. FIG. 5 represents a display shelf with a first stop tab 41 (not shown) engaging merchandise advancing member 32 such that merchandise advancing member 32 is permitted to travel only approximately two thirds of the distance between front portion 13 and rear portion 14 of tray 1. FIG. 6 represents a display shelf with a first stop tab 41 (not shown) disengaged and a second stop tab 42 (not shown) engaging merchandise advancing member 32 such that merchandise advancing member 32 is permitted to travel approximately four fifths of the distance between front portion 13 and rear portion 14 of tray 1. FIG. 7 represents a display shelf wherein no stop tabs are in position to restrict the rearward movement of merchandise advancing member 32 and accordingly, merchandise advancing member 32 is permitted to travel the full distance back toward rear portion 14 of tray 1.

As shown in FIGS. 5-7, by selectively positioning a stop tab disposed at a given distance along the length of a display shelf according to an embodiment of the invention, it is possible to restrict the rearward movement of merchandise advancing member 32 and thereby selectively limit the number of items of merchandise that the display shelf can hold. For example, with a stop tab in position to limit the merchandise advancing member 32 to a maximum rearward travel as shown in FIG. 5, the display shelf can accommodate fourteen items of merchandise of the size shown. When a stop tab is positioned to limit the merchandise advancing member 32 to a maximum rearward travel as shown in FIG. 6, eighteen items of merchandise having the same size as those shown in FIG. 5 may be placed in the display shelf. When no stop tabs are engaged, such that merchandise advancing member 32 is permitted to travel a full rearward distance, as shown in FIG. 7, twenty items of the same size can fit on the display shelf. Of course the stop tab locations, rearward travel of the merchandise advancing member and merchandise item dimensions shown in the Figures are exemplary only, and the configuration of the one or more stop tabs may be adjusted as appropriate to a particular application.

Although several embodiments of the present invention have been shown and described, it is obvious that many changes and modifications may be made thereunto without departing from the spirit and scope of the invention.

What is claimed is:

1. A display shelf for displaying a plurality of items of merchandise, the display shelf comprising:

a) a tray comprising a base, a front portion, a rear portion, a first side, a second side, and a track disposed on said base between said first side and said second side and extending substantially parallel to said first side and said second side;

b) a first side member disposed at said first side of said tray and slidably engaging said tray;

c) a second side member disposed at said second side of said tray and slidably engaging said tray, wherein said first side member and said second side member are displaceable for accommodating items of various widths;

d) a biasing mechanism for biasing the items of merchandise toward said front portion of said tray, said biasing mechanism comprising a biasing element and a merchandise advancing member slidably engaging said track; and e) a first stop tab disposed on said base of said tray for restricting a rearward movement of said merchandise advancing member to limit a number of the items of merchandise to be displayed on the display shelf, wherein said first stop tab is movable between a first position wherein said rearward movement of said merchandise advancing member is restricted and a second position wherein said rearward movement of said merchandise advancing member is not restricted.

2. The display shelf according to claim 1, wherein said first stop tab slidably engages a slot disposed on said base of said tray.

3. The display shelf according to claim 1, wherein said biasing element comprises a length of spring material secured to said front portion of said tray and extending under said merchandise advancing member, said length of spring material forming a coil disposed behind said merchandise advancing member, wherein said coil is uncoiled as said merchandise advancing member is moved toward said rear portion of said tray.

4. The display shelf according to claim 1, wherein said first side member comprises a first front projection for engaging said front portion of said tray and a first rear projection for engaging said rear portion of said tray and said second side member comprises a second front projection for engaging said front portion of said tray and a second rear projection for engaging said rear portion of said tray.

5. A display shelf for displaying a plurality of items of merchandise, the display shelf comprising:

a) a tray comprising a base, a front portion, a rear portion, a first side, a second side, and a track disposed on said base between said first side and said second side and extending substantially parallel to said first side and said second side;

b) a first side member disposed at said first side of said tray and comprising a first front projection for slidably engaging said front portion of said tray and a first rear projection for slidably engaging said rear portion of said tray;

c) a second side member disposed at said second side of said tray and comprising a second front projection for engaging said front portion of said tray and a second rear projection for engaging said rear portion of said tray, wherein said first side member and said second side member are displaceable for accommodating items of various widths;

d) a biasing mechanism for biasing the items of merchandise toward said front portion of said tray, said biasing mechanism comprising a biasing element and a merchandise advancing member slidably engaging said track;

e) a first stop tab disposed on said base of said tray; and f) a second stop tab disposed on said base of said tray, wherein said second stop tab is disposed at a greater distance from said front portion of said tray than said first stop tab, wherein said first stop tab and said second stop tab are each movable between a first position wherein a rearward movement of said merchandise advancing member is restricted and a second position wherein said rearward movement of said merchandise advancing member is not restricted.

6. A display shelf for displaying a plurality of items of merchandise, the display shelf comprising:

a) a tray comprising a base, a front portion, a rear portion, a first side, a second side, and a track disposed on said base between said first side and said second side and extending substantially parallel to said first side and said second side;

b) a biasing mechanism for biasing the items of merchandise toward said front portion of said tray, said biasing mechanism comprising a biasing element and a merchandise advancing member slidably engaging said track; and c) a stop tab disposed on said base of said tray for restricting a rearward movement of said merchandise advancing member to limit a number of the items of merchandise to be displayed on the display shelf said stop tab being movable between a first position wherein said rearward movement of said merchandise advancing member is restricted and a second position wherein said rearward movement of said merchandise advancing member is not restricted.

7. A display shelf for displaying a plurality of items of merchandise, the display shelf comprising:

a) a tray comprising a base, a front portion, a rear portion, a first side, a second side, and a track disposed on said base between said first side and said second side and extending substantially parallel to said first side and said second side;

b) a first side member disposed at said first side of said tray and slidably engaging said tray;

c) a second side member disposed at said second side of said tray and slidably engaging said tray, wherein said first side member and said second side member are displaceable for accommodating items of various widths;

d) a biasing mechanism for biasing the items of merchandise toward said front portion of said tray, said biasing mechanism comprising a biasing element and a merchandise advancing member slidably engaging said track;

e) a first stop tab disposed on said base of said tray for restricting a rearward movement of said merchandise advancing member to limit a number of the items of merchandise to be displayed on the display shelf; and f) a second stop tab disposed on said base of said tray for restricting said rearward movement of said merchandise advancing member, wherein said second stop tab is disposed at a greater distance from said front portion of said tray than said first stop tab.

8. The display shelf according to claim 7, wherein said first stop tab is disposed adjacent to said first side of said tray and said second stop tab is disposed adjacent to said second side of said tray.

* * * * *